US010394175B2

(12) United States Patent
Zaima

(10) Patent No.: US 10,394,175 B2
(45) Date of Patent: Aug. 27, 2019

(54) IMAGE FORMING APPARATUS THAT USES A PREDETERMINED MEASUREMENT IMAGE AND CONTROLS IMAGE DENSITY

(71) Applicant: CANON KABUSHIKI KAISHA, Tokyo (JP)

(72) Inventor: Nobuhiko Zaima, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/934,170

(22) Filed: Mar. 23, 2018

(65) Prior Publication Data

US 2018/0284675 A1 Oct. 4, 2018

(30) Foreign Application Priority Data

Mar. 29, 2017 (JP) ..... 2017-065075

(51) Int. Cl.
*G03G 15/00* (2006.01)

(52) U.S. Cl.
CPC ..... *G03G 15/5058* (2013.01); *G03G 2215/00042* (2013.01)

(58) Field of Classification Search
CPC ..... G03G 15/5058
USPC ..... 399/49
See application file for complete search history.

(56) References Cited

U.S. PATENT DOCUMENTS

2002/0110381 A1 8/2002 Maebashi et al.
2016/0077458 A1* 3/2016 Shirafuji ..... G03G 15/5058 399/49

* cited by examiner

*Primary Examiner* — Quana Grainger
(74) *Attorney, Agent, or Firm* — Rossi, Kimms & McDowell LLP

(57) ABSTRACT

An image forming apparatus that is capable of finding density of an output image with high accuracy even if reflectance of an image bearing member varies. A conversion unit converts image data based on a conversion condition. An image forming unit forms an image based on the converted image data. A measurement unit measures irregular reflection light from a measurement image on the image bearing member. A controller controls the image forming unit to form measurement images, controls the measurement unit to measure irregular reflection light from an area on the image bearing member where the measurement images are not formed, controls the measurement unit to measure the irregular reflection light from the measurement images, selects a measurement result from among measurement results of the measurement images based on the measurement result of the area, and generates the conversion condition based on the selected measurement result.

6 Claims, 11 Drawing Sheets

IMAGE FORMING APPARATUS THAT USES A PREDETERMINED MEASUREMENT IMAGE AND CONTROLS IMAGE DENSITY

BACKGROUND OF THE INVENTION

Field of the Invention

The present invention relates to an image forming apparatus that controls image density.

Description of the Related Art

A full color image forming apparatus that employs an electrophotographic system forms toner images of color components by developing electrostatic latent images formed on photosensitive members with developers including toners of the-color components. The toner images of the color components are transferred to an intermediate transfer medium in piles by a transfer unit, so that a full color toner image corresponding to an original appears. The toner image transferred to the intermediate transfer medium is again transferred to a recording material like a sheet, and then is fixed to the recording material by applying heat and pressure by a fixing unit. The recording material to which the toner image has been fixed is output from the image forming apparatus as a printed matter.

Such an image forming apparatus controls image forming conditions, such as an exposure light amount for forming an electrostatic latent image on a photosensitive member, exposure time, developing bias, and electrification potential, in order to control density of an output image. However, even if the image formation conditions are controlled so as to be constant, image density may vary because of temporal changes of states of the image forming apparatus, such as a charge amount of toner, sensitivity of a photosensitive member, and a transfer efficiency, and changes of environmental conditions, such as temperature and humidity.

For example, in a system that develops a latent image by a predetermined development contrast potential, deviation of a charge amount of toner from a reference value changes a toner amount (the number of toner particles) required to satisfy the development contrast potential. That is, an increase of the charge amount of toner decreases the toner amount, and a decrease of the charge amount of toner increases the toner amount. Then, the decrease of the toner amount used for development lowers density of a toner image. Moreover, the change of the sensitivity of the photosensitive member due to the temporal changes or the changes of the environmental conditions may also change the electric potential on the photosensitive member.

The image density varies in response to the changes of the image forming conditions or of the states of the image forming apparatus.

There is a conventional technique that forms a test pattern on an image bearing member, such as a photosensitive member and an intermediate transfer belt. The test pattern is detected with an optical sensor, and image forming conditions, such as an exposure light amount and exposure time, are feedback-controlled on the basis of a detection result.

However, it is known that a huge amount of image formations change a glossiness of a surface of an image bearing member over time in an image forming apparatus. Since a reflectance of the image bearing member varies according to the temporal variation of the glossiness of the image bearing member, a reflected light amount varies over time even if a toner amount of a toner image on the image bearing member is constant.

There is a proposed technique that finds a correction amount on the basis of a reflected light amount from an image bearing member on which a test pattern will be formed and corrects a reflected light amount from the test pattern using the correction amount (for example, see US 2002/0110381). The image forming apparatus disclosed in this publication predicts a correction coefficient corresponding to the change of the reflectance of the image bearing member, and corrects the detection result of the test pattern on the basis of the correction coefficient.

However, a sensor output is affected by ratio (no-toner area ratio) of an area where the toner of the test pattern does not cover the image bearing member in a sensor detection area. Accordingly, the image forming apparatus needs to correct the detection result of the sensor in consideration of the no-toner area ratio and the change of the reflectance of the image bearing member. Particularly, when a low-density test pattern with a high no-toner area ratio is detected, density of an output image cannot be corrected with high accuracy unless both the no-toner area ratio and the change of the reflectance of the image bearing member are considered.

SUMMARY OF THE INVENTION

The present invention provides an image forming apparatus that is capable of finding density of an output image with high accuracy even if reflectance of an image bearing member varies.

Accordingly, a first aspect of the present invention provides an image forming apparatus that forms an image on a sheet, the image forming apparatus including a conversion unit configured to convert image data based on a conversion condition, an image forming unit configured to form an image based on the converted image data, an image bearing member, a measurement unit configured to measure irregular reflection light from a measurement image on the image bearing member, and a controller configured to control the image forming unit to form a plurality of measurement images including a predetermined measurement image based on measurement image data, to control the measurement unit to measure irregular reflection light from an area on the image bearing member where the plurality of measurement images are not formed, to control the measurement unit to measure the irregular reflection light from the plurality of measurement images, to determine whether a measurement result of the predetermined measurement image is selected as a measurement result used for generating the conversion condition based on the measurement result of the area, and to generate the conversion condition based on the selected measurement result. The controller generates the conversion condition based on the measurement result of the predetermined measurement image and measurement results of the other measurement images among the plurality of measurement images in a case where the measurement result of the predetermined measurement image is selected. The controller generates the conversion condition based on the measurement results of the other measurement images without using the measurement result of the predetermined measurement image in a case where the measurement result of the predetermined measurement image is not selected. A density level of the predetermined measurement image is lower than density levels of the other measurement images.

Accordingly, a second aspect of the present invention provides an image forming apparatus that forms an image on a sheet, the image forming apparatus including a conversion unit configured to convert image data based on a conversion condition, an image forming unit configured to form an image based on the converted image data, an image bearing member, a measurement unit configured to measure irregular reflection light from a measurement image on the image bearing member, and a controller configured to control the image forming unit to form a plurality of measurement images based on measurement image data, to control the measurement unit to measure irregular reflection light from an area on the image bearing member where the plurality of measurement images are not formed, to control the measurement unit to measure the irregular reflection light from the plurality of measurement images, to select a measurement result used for generating the conversion condition from among measurement results of the plurality of measurement images based on the measurement result of the area, and to generate the conversion condition based on the selected measurement result.

According to the present invention, density of an output image is found with high accuracy even if reflectance of the image bearing member varies Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
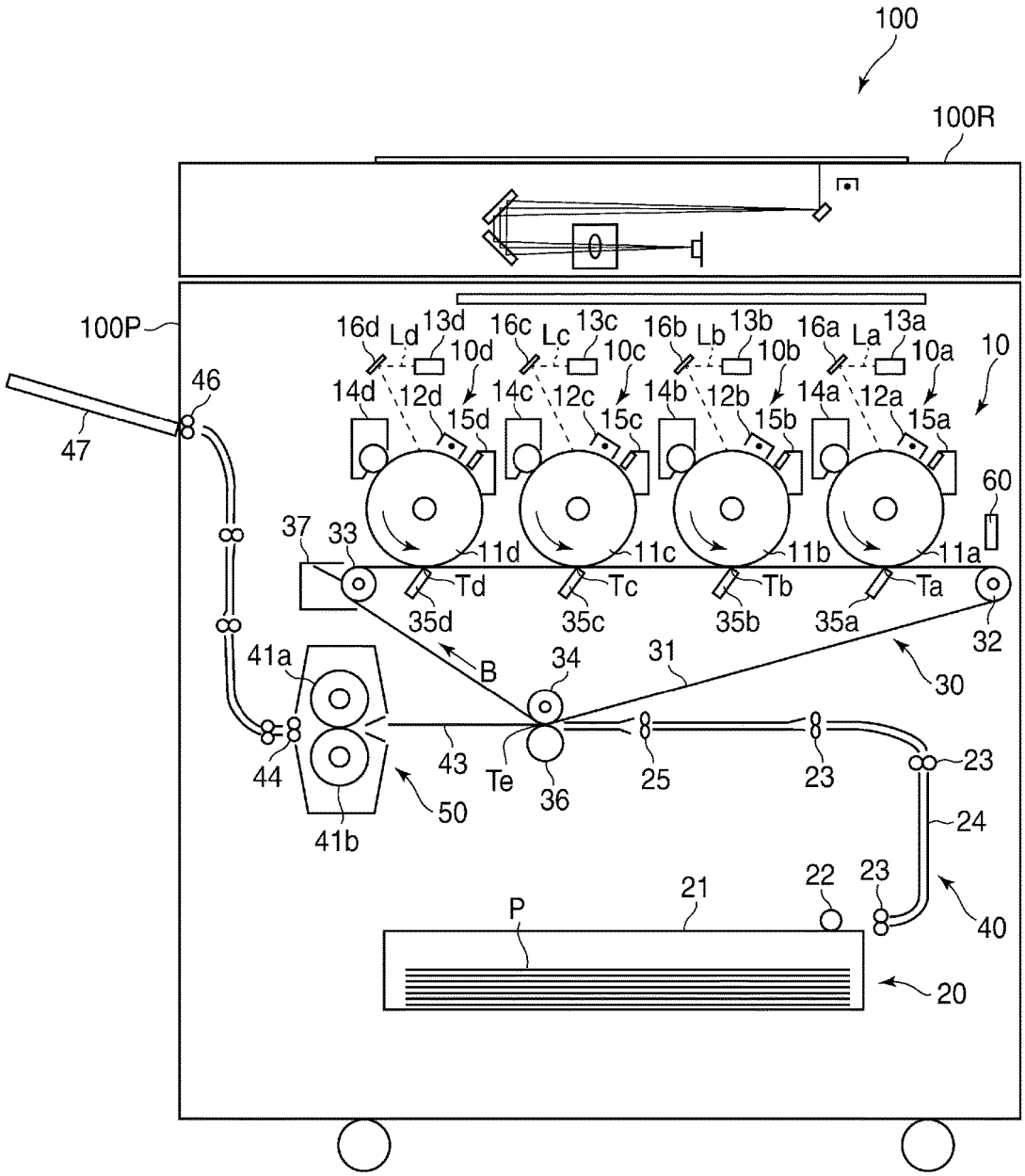
FIG. 1 is a sectional view schematically showing a configuration of an image forming apparatus according to a first embodiment of the present invention.
Figure 2:
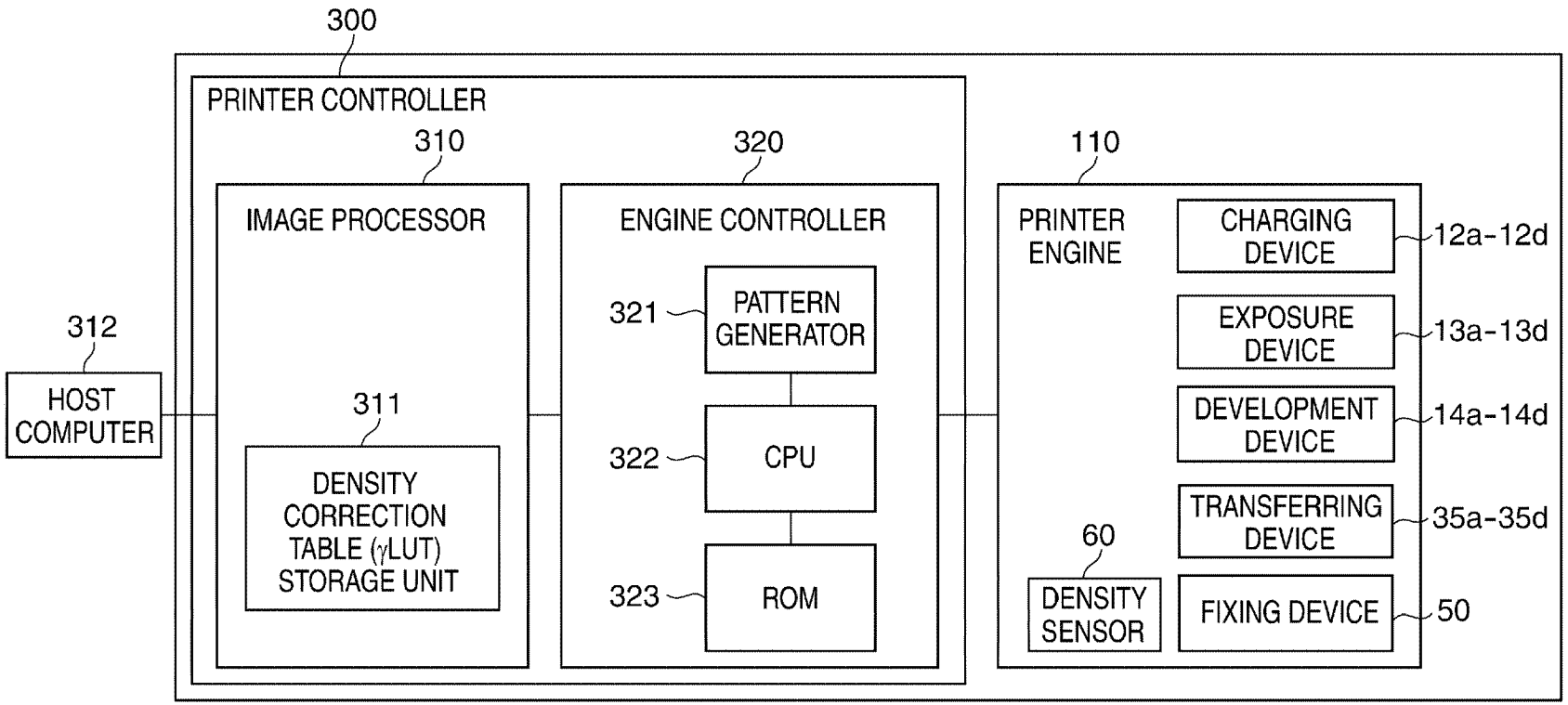
FIG. 2 is a block diagram schematically showing a control system of the image forming apparatus in FIG. 1.

FIG. 1 is a sectional view schematically showing a configuration of an image forming apparatus 100 according to a first embodiment of the present invention. The image forming apparatus 100 is provided with a reader 100R and a printer 100P. The reader 100R reads an original image optically, converts a read signal into image data, and sends the image data to the printer 100P. The printer 100P is a tandem electrophotographic color printer in which a plurality of image forming stations are arranged in parallel in an approximately horizontal direction. The printer 100P forms an image according to the image data sent from the reader 100R. Moreover, the printer 100P forms an image according to image data transmitted from an external host computer 312 (FIG. 2).

The printer 100P is provided with an image forming unit 10, a feeding unit 20, an intermediate transfer belt 31 as a transfer unit 30, a conveyance unit 40, and a fixing device 50.

The image forming unit 10 has four image forming stations 10*a*, 10*b*, 10*c*, and 10*d* that respectively form black, cyan, magenta, and yellow toner images. The image forming stations 10*a*, 10*b*, 10*c*, and 10*d* are respectively provided with photosensitive drums 11*a*, 11*b*, 11*c*, and 11*d* as image bearing members. The photosensitive drums 11*a*, 11*b*, 11*c*, and 11*d* are supported rotatably in arrow directions in FIG. 1. Charging devices 12*a*, 12*b*, 12*c*, and 12*d*, exposure devices 13*a*, 13*b*, 13*c*, and 13*d*, development devices 14*a*, 14*b*, 14*c*, and 14*d*, and drum cleaners 15*a*, 15*b*, 15*c*, and 15*d* are respectively arranged around the photosensitive drums 11*a*, 11*b*, 11*c*, and 11*d*.

The charging devices 12*a*, 12*b*, 12*c*, and 12*d* respectively give electric charge of uniform charge amount to the surfaces of the photosensitive drums 11*a*, 11*b*, 11*c*, and 11*d*. The exposure devices 13*a*, 13*b*, 13*c*, and 13*d* respectively emit laser beams La, Lb, Lc, and Ld for exposing the photosensitive drums 11*a*, 11*b*, 11*c*, and 11*d* according to signals (image signals) from the reader 100R or the host computer 312. The laser beams La, Lb, Lc, and Ld respectively scan the photosensitive drums 11*a*, 11*b*, 11*c*, and 11*d* via folding mirrors 16*a*, 16*b*, 16*c*, and 16*d*. Accordingly, electrostatic latent images are formed on the photosensitive drums 11*a*, 11*b*, 11*c*, and 11*d*. The development devices 14*a*, 14*b*, 14*c*, and 14*d* respectively develop the electrostatic latent images by supplying developer to the photosensitive drums 11*a*, 11*b*, 11*c*, and 11*d*.

Primarily transfer members 35*a*, 35*b*, 35*c*, and 35*d* are arranged so as to face the photosensitive drums 11*a*, 11*b*, 11*c*, and 11*d*, respectively. Positions at which the intermediate transfer belt 31 contacts the photosensitive drums 11*a*, 11*b*, 11*c*, and 11*d* by the primarily transfer members 35*a*, 35*b*, 35*c*, and 35*d* serve as primarily transfer nip positions Ta, Tb, Tc, and Td. The intermediate transfer belt 31 is stretched by a plurality of stretching rollers 32, 33, and 34 so as to be rotatable in a direction of an arrow B in FIG. 1.

A density sensor 60 as a density detector is arranged above the stretching roller 32 so as to face the intermediate transfer belt 31. The density sensor 60 detects an image pattern (hereinafter referred to as a "test pattern") for measurement formed on the intermediate transfer belt 31. Details of the density sensor 60 will be described later.

A belt cleaner 37 is arranged so as to face the stretching roller 33 across the intermediate transfer belt 31. The belt cleaner 37 cleans an outside of the intermediate transfer belt 31. Moreover, a secondary transfer roller 36 is arranged so as to face the stretching roller 34 across the intermediate transfer belt 31. A contact position of the secondary transfer roller 36 and the intermediate transfer belt 31 serves as a secondary transfer nip position Te.

The feeding unit 20 provided in the lower part of the printer 100P has a sheet cassette 21. The sheet cassette 21 stores a sheet P as a recording material. The conveyance unit 40 between the feeding unit 20 and the transfer unit 30 is provided with a conveyance path 24. The conveyance path 24 is provided with a pickup roller 22 provided in the sheet cassette 21, a plurality of conveying roller pairs 23, and a registration roller pair 25. The conveyance path 24 conveys the sheet P stored in the sheet cassette 21 to the secondary transfer nip position Te. The fixing device 50 is arranged at the downstream side of the secondary transfer nip position Te. The fixing device 50 is provided with a heating roller 41*a* and a pressure roller 41*b*. Ejection rollers 44 and 46 are arranged in the conveyance path at the downstream side of the fixing device 50.

Next, a control system of the image forming apparatus in FIG. 1 will be described. FIG. 2 is a block diagram schematically showing the control system of the image forming apparatus in FIG. 1. As shown in FIG. 2, the image forming apparatus 100 is provided with a printer controller 300. The printer controller 300 consists of an image processor 310 and an engine controller 320.

The image processor 310 has a density correction table (γLUT) storage unit 311. Moreover, the image processor 310 is connected with the external host computer 312 so as to be communicable. The engine controller 320 has a pattern generator 321, a CPU 322, and a ROM 323. The engine controller 320 is connected to the printer engine 110 of the image forming apparatus 100. The printer engine 110 is provided with the charging devices 12*a* through 12*d*, the exposure devices 13*a* through 13*d*, the development device 14*a* through 14*d*, the transfer devices (primarily transfer members) 35*a* through 35*d*, the fixing device 50, and the density sensor 60.

The density correction table storage unit 311 in the image processor 310 stores a density correction table that is used for converting an input signal value of image data so that a tone characteristic of the image forming apparatus 100 becomes ideal. The CPU 322 determines parameters in connection with the image forming apparatus 100, transmits the parameters to devices constituting the image forming apparatus 100, and controls the devices to perform an image forming operation.

The engine controller 320 sends test pattern information for density correction to the printer engine 110 and controls the printer engine 110 to form a test pattern at the time of image density control. The density sensor 60 detects a reflected light amount from the test pattern as an output value. The detected output value is sent to the CPU 322. The CPU 322 generates the density correction table as an image forming condition on the basis of an output value, and it makes the density correction table storage unit 311 of the image processor 310 send and store it.

Next, an image forming operation in the image forming apparatus 100 of such a configuration will be described.

The charging devices 12*a*, 12*b*, 12*c*, and 12*d* first charge the surfaces of the photosensitive drums 11*a*, 11*b*, 11*c*, and 11*d* uniformly. Next, the exposure devices 13*a*, 13*b*, 13*c*, and 13*d* expose the photosensitive drums 11*a*, 11*b*, 11*c*, and 11*d* according to the image signals output from the reader 100R. Accordingly, electrostatic latent images are formed on the photosensitive drums 11*a*, 11*b*, 11*c*, and 11*d*.

The electrostatic latent images formed on the photosensitive drums 11*a*, 11*b*, 11*c*, and 11*d* are developed by the toner supplied from the development devices 14*a*, 14*b*, 14*c*, and 14*d*, and turn into toner images of the four colors. The toner images move to the primarily transfer nip positions Ta, Tb, Tc, and Td according to rotations of the photosensitive drums 11*a*, 11*b*, 11*c*, and 11*d*, and are transferred in order onto the intermediate transfer belt 31 in piles by the transfer voltage from the primarily transfer members 35*a*, 35*b*, 35*c*, and 35*d*. Accordingly, a full color toner image is formed on the intermediate transfer belt 31. Residual toner on the photosensitive drums 11*a*, 11*b*, 11*c*, and 11*d* that was not transferred at the primarily transfer nip positions Ta, Tb, Tc, and Td to the intermediate transfer belt 31 is removed by the drum cleaners 15*a*, 15*b*, 15*c*, and 15*d*.

The toner image on the intermediate transfer belt 31 is conveyed by rotation of the intermediate transfer belt 31 to the secondary transfer nip position Te. At this time, the sheet P in the sheet cassette 21 is conveyed by the pickup roller 22 and the conveying roller pairs 23. The conveyed sheet P is carried to the secondary transfer nip position Te after a position and a sending timing of the sheet P are adjusted by the registration roller pair 25.

When the toner image on the intermediate transfer belt 31 and the sheet P sent out from the registration roller pair 25 are carried to the secondary transfer nip position Te, a transfer electric field is formed between the secondary transfer roller 36 and the stretching roller 34 by a power source (not shown). The toner image on the intermediate transfer belt 31 is transferred to the sheet P by this transfer electric field. The residual toner on the intermediate transfer belt 31 that was not transferred to the sheet P is removed by the belt cleaner 37.

The sheet P to which the toner image was transferred is conveyed to the fixing device 50 along a guide 43. The toner image on the sheet P carried in the fixing device 50 is heated and pressurized by the heating roller 41*a* and the pressure roller 41*b*. This fixes the toner image to the sheet P. The sheet P on which the toner image is fixed is ejected onto a tray 47 by ejection roller pairs 44 and 46.

Next, a density-correction-table generation process executed when the image forming apparatus 100 in FIG. 1 forms an image will be described.

Figure 3:
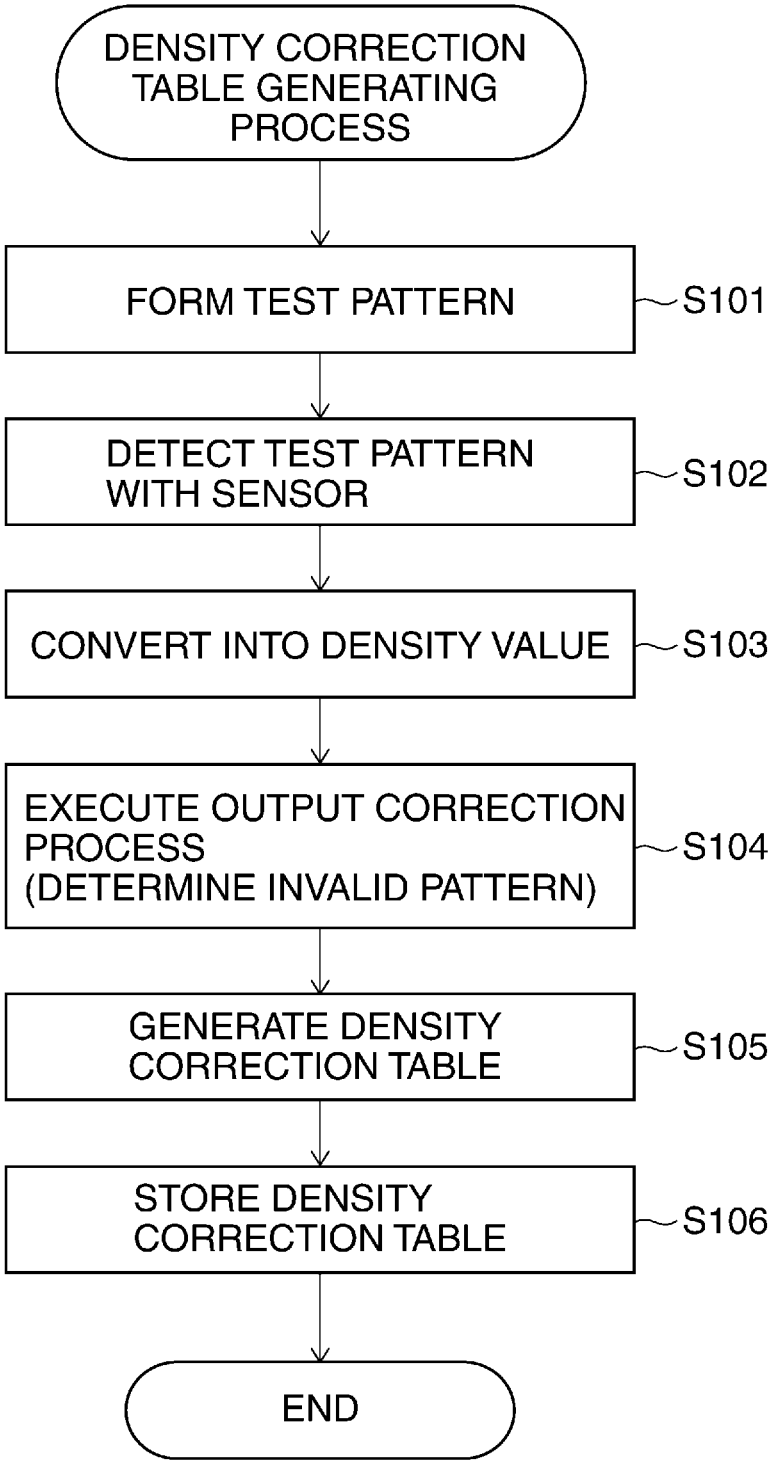
FIG. 3 is a flowchart showing a density-correction-table generation process executed by the image forming apparatus in FIG. 1.

FIG. 3 is a flowchart showing procedures of the density-correction-table generation process executed by the image forming apparatus 100 in FIG. 1. The CPU 322 in the engine controller 320 of the image forming apparatus 100 executes this density-correction-table generation process according to a density-correction-table generation program stored in the ROM 323. In order to stabilize image density, the density-correction-table generation process is executed immediately after the main power supply of the image forming apparatus 100 is turned ON and is executed whenever the accumulated printed sheet number exceeds 200, for example.

As shown in FIG. 3, when the density-correction-table generation process starts, the CPU 322 controls the pattern generator 321 to send test pattern information (measurement image data) to the printer engine 110. Then, the CPU 322 controls the printer engine 110 to form a test pattern (measurement images) for density control on the basis of the test pattern information (step S101). Specifically, the test pattern is formed on the intermediate transfer belt 31 as the intermediate transfer medium by transferring respective images formed on the photosensitive drums 11*a* through 11*d*.

Figure 4:
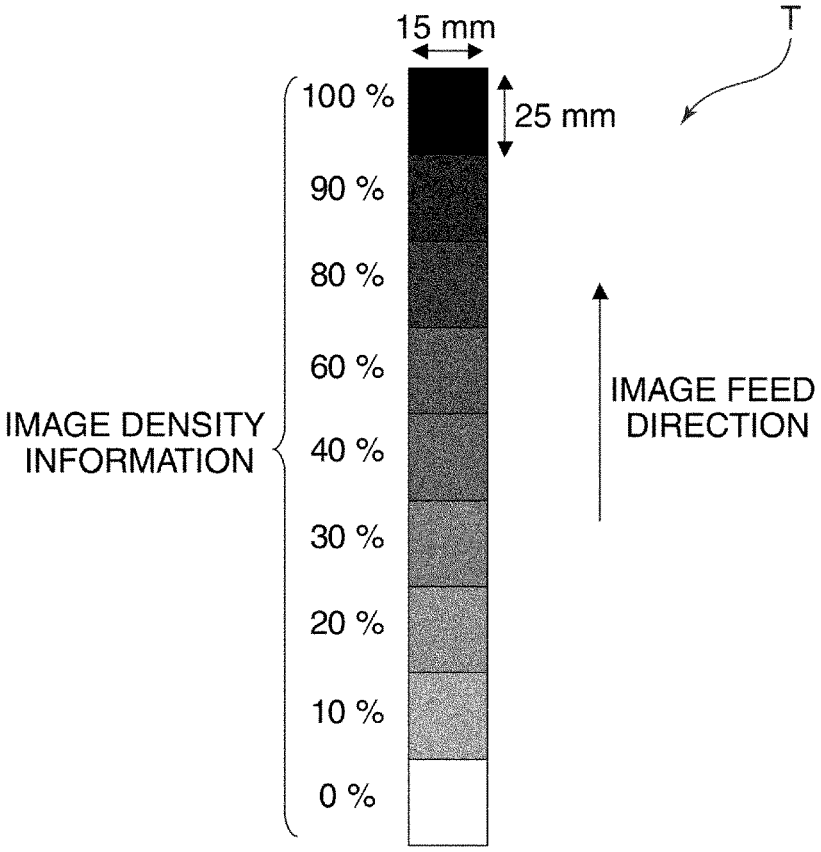
FIG. 4 is a view showing an example of a test pattern for density control.

FIG. 4 is a view showing an example of the test pattern for density control. As shown in FIG. 4, the test pattern T consists of measurement images of nine tones (nine density levels) that correspond to input image signals of 100%, 90%, 80%, 60%, 40%, 30%, 20%, 10%, and 0%. A width of each measurement image in the direction (principal scanning direction) in which the laser beam scans the photosensitive drum is 15 mm and a length in the direction (auxiliary scanning direction) that perpendicularly intersects the principal scanning direction is 25 mm.

One of the nine tones is used for correction and its input image signal is set to 0% in order to detect the reflected light from the intermediate transfer belt 31 as an image bearing member. That is, the test pattern T includes a measurement image of a low-density region of which an input image signal is 30% or less. The measurement image of which the input image signal is 0% is equivalent to the area of the intermediate transfer belt 31 in which the test pattern is not formed.

Referring back to FIG. 3, after controlling to form the test pattern T, the CPU 322 detects the test pattern T formed on the intermediate transfer belt 31 by controlling the density sensor 60 (step S102).

Figure 5:
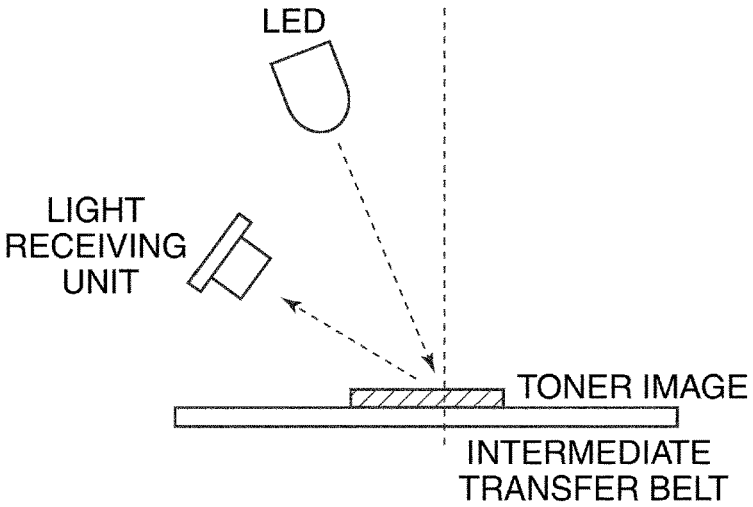
FIG. 5 is a view for describing a principle of a density sensor.

FIG. 5 is a view for describing a principle of the density sensor 60. The density sensor 60 is a diffuse reflection optical sensor that detects a diffuse reflection component of light applied to a detection object, and is arranged so as to face an image bearing surface of the intermediate transfer belt 31.

As shown in FIG. 5, the density sensor 60 mainly consist of an LED as a light source, and a light receiving section that receives diffuse reflection light. An LED wavelength shall be 840 nm, for example. The light applied to the intermediate transfer belt 31 and the test pattern T from the LED is reflected as diffuse reflection light (irregular reflection light) from the intermediate transfer belt 31 and the test pattern T. The density sensor 60 detects the diffuse reflection light and outputs an output value corresponding to reflected light intensity as a voltage value.

When detecting the test pattern T, the density sensor 60 outputs an output value as an analog voltage value every 2 msec, and outputs twenty-five output values in all for each of the measurement images. An output value is converted into a 10-bit digital signal by an A/D converter, for example. Then, an average of the twenty-three output values excepting the maximum and minimum values from the twenty-five output values is calculated as a detection value SigV.

Figure 6:
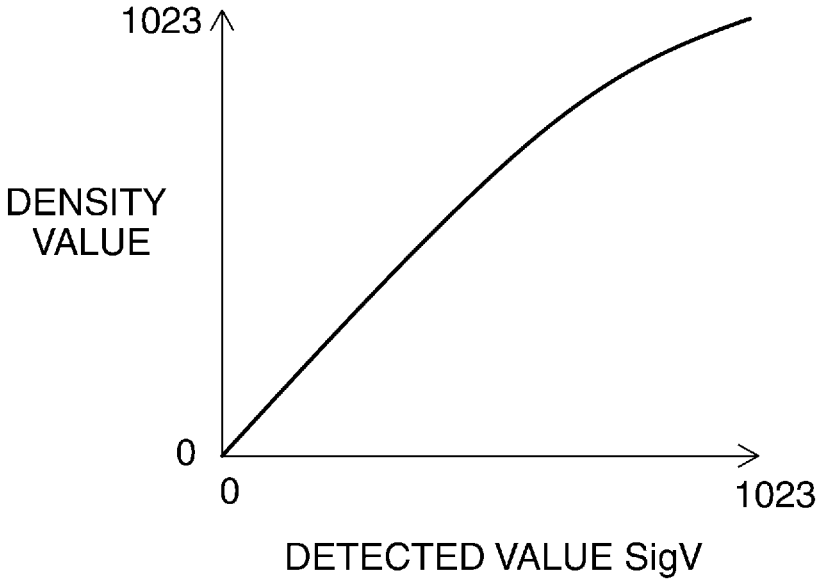
FIG. 6 is a graph showing an example of a density conversion table.

Referring back to FIG. 3, after controlling the density sensor 60 to detect the test pattern T (step S102), the CPU 322 converts the detection value SigV of the density sensor 60 into a density value by using a density conversion table shown in FIG. 6 (step S103). FIG. 6 shows a relation between the detection value SigV of the density sensor 60 and the density value.

Referring back to FIG. 3, after converting the detection value SigV of the density sensor 60 into the density value (step S103), the CPU 322 executes an output correction process to the converted density value (step S104).

Hereinafter, the output correction process will be described. The diffuse reflection light includes reflected light from the toner constituting the test pattern and the reflected light from the intermediate transfer belt 31 that bears the toner. Accordingly, it is necessary to subtract an offset amount equivalent to the reflected light from the intermediate transfer belt 31 from the output value in order to detect the density value of the test pattern T correctly. In the specification, the process that subtracts the offset amount from the output value is referred to as the output correction process. It should be noted that the offset amount varies according to the reflectance of the intermediate transfer belt 31.

Figure 7A:
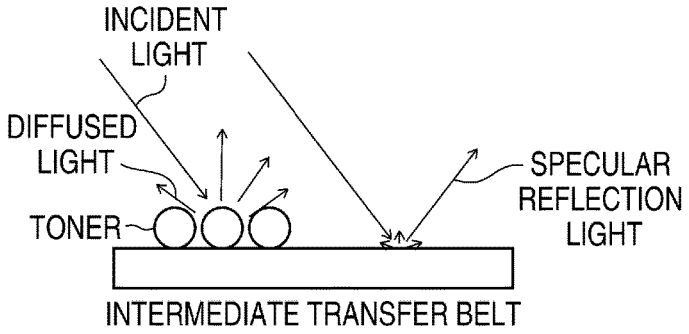
FIG. 7A and FIG. 7B are views for describing influence of reflectance change of the image bearing member on an output of the density sensor.
Figure 7B:
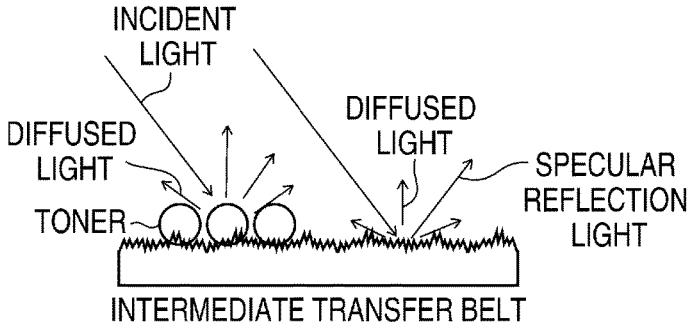
Figure 7C:
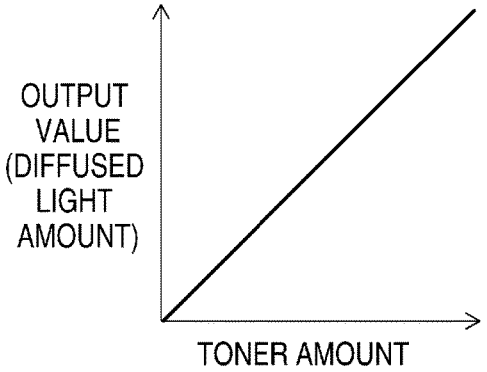
FIG. 7C and FIG. 7D are graphs showing relations between the output of the density sensor and a toner amount in the states in FIG. 7A and FIG. 7B, respectively.
Figure 7D:
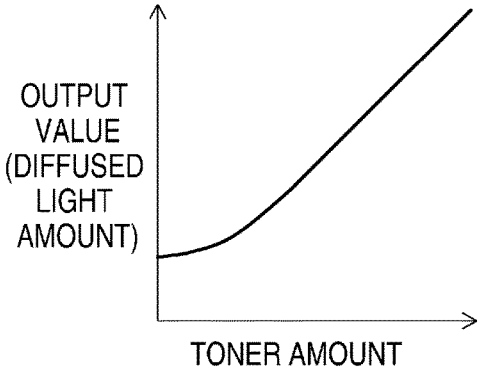

Hereinafter, influence of the reflectance change of the intermediate transfer belt 31 on the output value will be described with reference to FIG. 7A through FIG. 7D. FIG. 7A and FIG. 7B are views for describing the influence of the reflectance change of the intermediate transfer belt 31 on the output value of the density sensor 60. FIG. 7C and FIG. 7D are graphs showing relations between the output value of the density sensor 60 and the toner amount in the states in FIG. 7A and FIG. 7B, respectively.

If the surface of the intermediate transfer belt 31 is a mirror surface state as shown in FIG. 7A, a diffuse-reflection light amount from the intermediate transfer belt 31 is extremely small. This is because the most part of the light emitted from the LED is specularly reflected by the intermediate transfer belt 31. In this case, the toner amount of the test pattern T is in direct proportion to the detection value of the density sensor 60 as shown in FIG. 7C.

However, if the surface of the intermediate transfer belt 31 becomes rough as shown in FIG. 7B, the diffuse reflection light includes diffused light from the intermediate transfer belt 31. In this case, the toner amount is not in direct proportion to the output value of the sensor as shown in FIG. 7D. In the relationship between the toner amount and the output value shown in FIG. 7D, linearity is broken in the low-density region of the test pattern T particularly.

The influence of the diffused light from the intermediate transfer belt 31 on the output value of the density sensor 60 is in direct proportion to the reflected light amount from the intermediate transfer belt 31, i.e., to the area of the intermediate transfer belt 31 that is not covered with the toner. Hereinafter, the ratio of area that the toner of the test pattern T does not cover the intermediate transfer belt 31 in the detection area of the density sensor 60 is referred to as no-toner area ratio.

Figure 8:
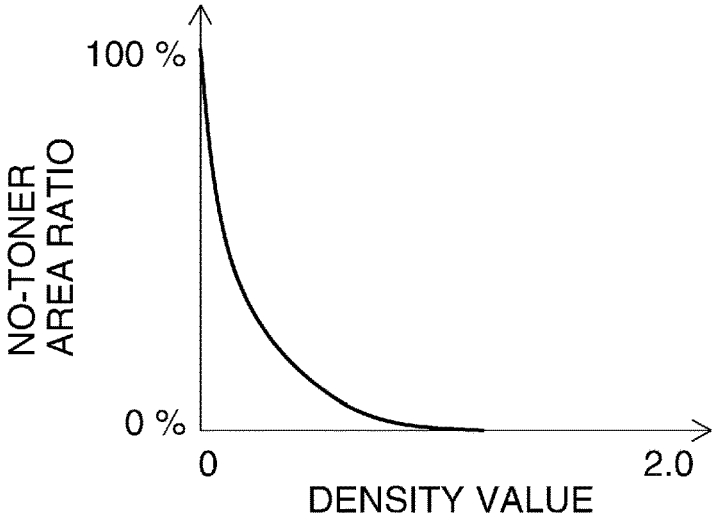
FIG. 8 is a graph showing a relation between the toner amount (image density) that is found on the basis of the detection value of the density sensor and no-toner area ratio.

FIG. 8 is a graph showing a relation between the toner amount that is found on the basis of the detection value of the density sensor 60 and the no-toner area ratio. As shown in FIG. 8, the fewer the toner amount and the smaller the density value are, the larger the no-toner area ratio is.

The detection value SigV output when the density sensor 60 detects the toner image is expressed as the following formula (1), where a symbol SigT denotes the component of the diffused light from the toner image, a symbol SigB denotes the component of the diffused light from the intermediate transfer belt 31, a symbol Mt denotes the toner amount, a symbol Rt denotes diffuse reflectance, a symbol Sb denotes the no-toner area ratio, and a symbol Rb denotes diffuse reflectance of the intermediate transfer belt 31.

$$\mathrm{Sig}V=\mathrm{Sig}T+\mathrm{Sig}B=Rt\cdot Mt+Rb\cdot Sb \qquad \text{Formula (1)}$$

The formula (1) shows that the influence of the diffused light from the intermediate transfer belt 31 on the detection value becomes large in the low-density region with few toner amounts.

Accordingly, the output correction process is applied to the detection value in the low-density region output when the density sensor 60 detects the test pattern T, and the tone characteristic of the image forming apparatus 100 is found by using the density value obtained on the basis of the post-correction value in the first embodiment.

Figure 9:
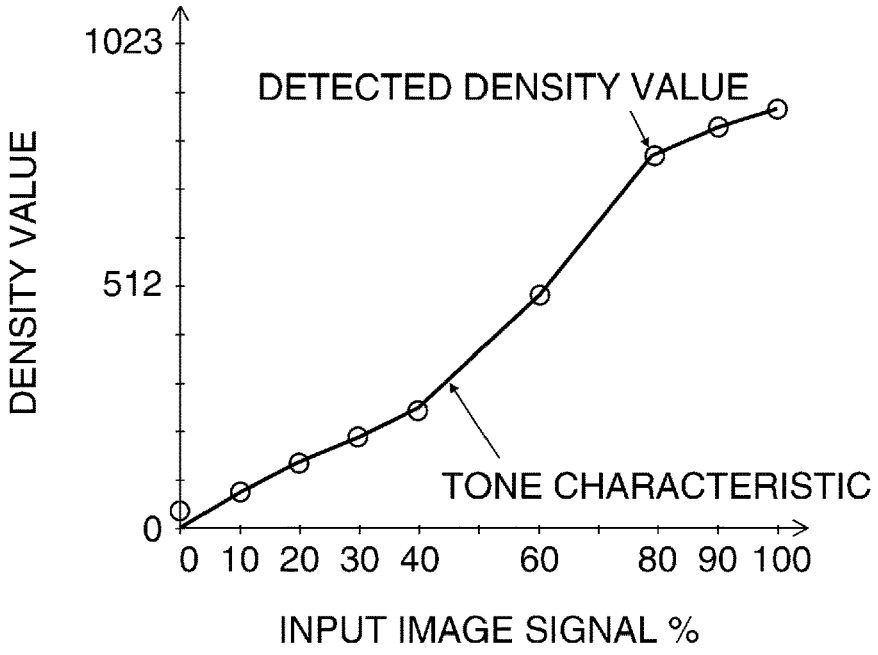
FIG. 9 is a graph showing a tone characteristic of a printer engine.

FIG. 9 is a graph showing the tone characteristic of the printer engine. The tone characteristic of the image forming apparatus 100 is found by converting the detection value output when the density sensor 60 detects the test pattern T into the density value using the density conversion table in FIG. 6 and by linearly interpolating a density value corresponding to each input image signal.

Hereinafter, a discrete density value corresponding to a measurement image of each tone output when the density sensor 60 detects the test pattern T is referred to as a detected density value (measurement result), and a detected density value corresponding to the input image signal 0% is particularly referred to as a reference density value (reference value).

It should be noted that the reference density value is not employed as the density value corresponding to the measurement image of the input image signal 0%, but a density value 0 (zero point (0, 0)) is employed as shown in FIG. 9.

Figure 10:
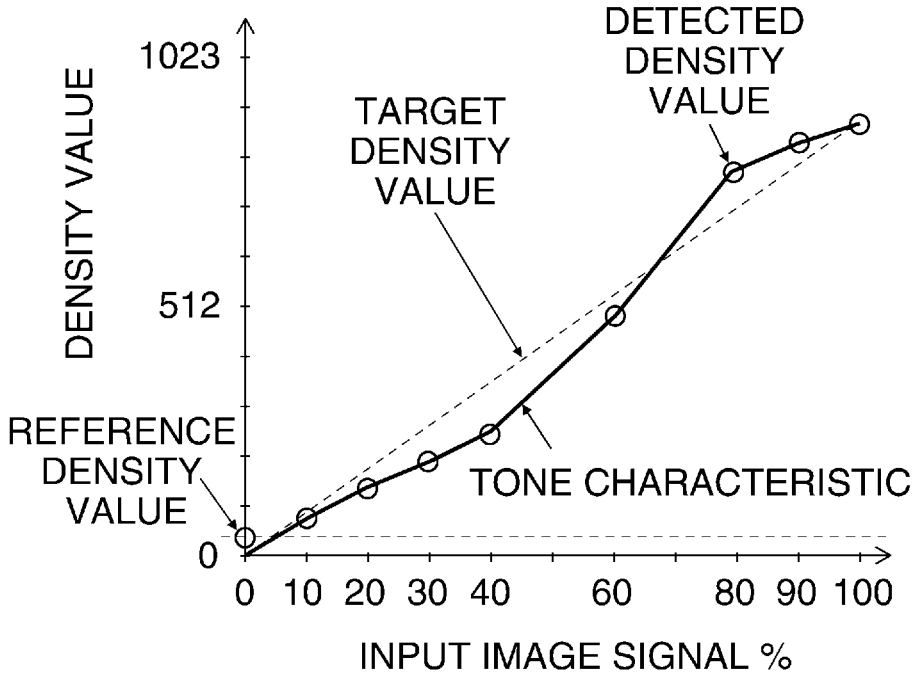
FIG. 10 is a graph showing a relation between the tone characteristic of the printer engine, a target density value, and a reference density value.

Hereinafter, a concrete output correction process will be described. FIG. 10 is a graph showing a relation between the tone characteristic of the printer engine, a target density value (target measurement result), and the reference density value. The target density value is a density value at which an ideal tone characteristic corresponding to an input image signal is obtained. The ideal tone characteristic is a characteristic where the input image signal is in direct proportion to the density value, for example.

Since the detection accuracy of the sensor output value corresponding to the measurement image in the low-density region of the test pattern is low, a sufficient effect of the output correction process is not obtained when the detected density value corresponding to the output value concerned is subjected to the output correction process. Accordingly, a target density value to each input signal is subjected to the output correction process instead of the detected density value in the first embodiment.

As shown in FIG. 10, when the reference density value is less than the target density values corresponding to the input image signals other than 0%, the CPU 322 finds the tone characteristic by connecting the detected density values except the reference density value corresponding to 0% and the zero point (0, 0).

In the meantime, when the reference density value is not less than a target density value corresponding to any one of the input image signals other than 0%, the CPU 322 invalidates a detected density value corresponding to an input image signal of which a target density value is less than the reference density value. The CPU 322 does not use the invalid value for finding the tone characteristic. That is, since there is a high possibility that the detection value corresponding to the input image signal of which the target density value is less than the reference density value is incorrect, the detected density value corresponding to the detection value is not used for generating the tone characteristic.

Figure 11A:
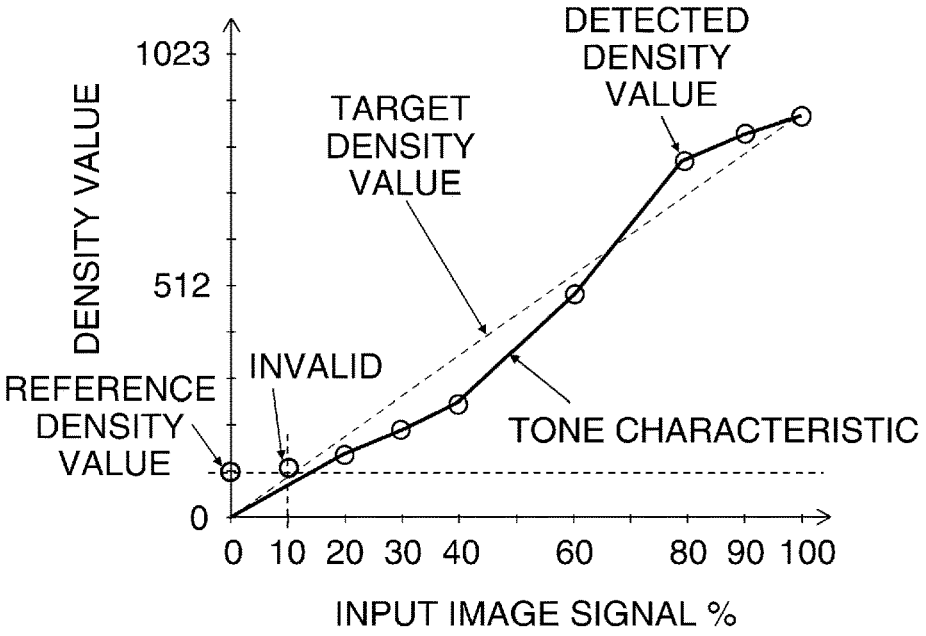
FIG. 11A and FIG. 11B are graphs for describing an output correction process in the first embodiment.
Figure 11B:
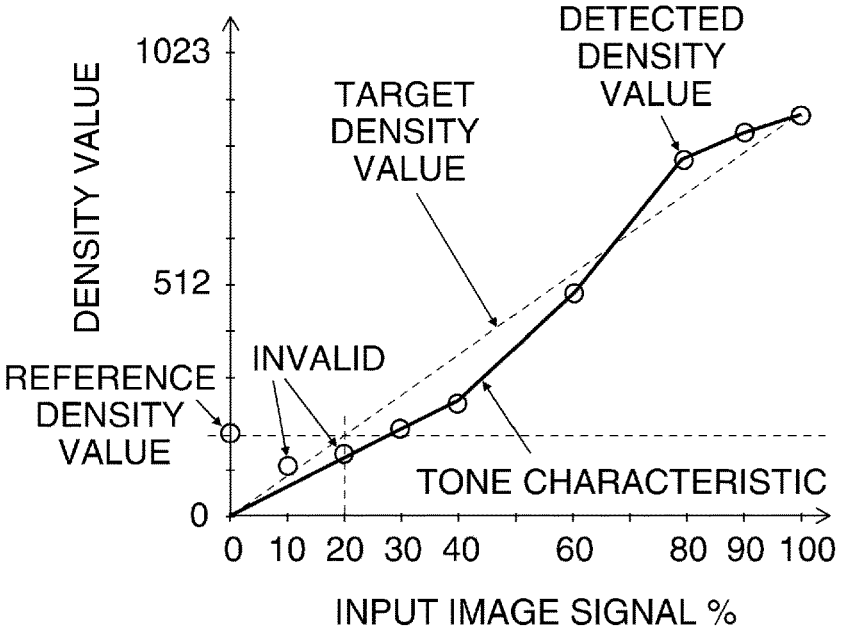

FIG. 11A and FIG. 11B are graphs for describing the output correction process in the first embodiment. Specifically, the graphs show the generation method of the tone characteristic in a case where the reference density value exceeds a part of the target density values.

FIG. 11A shows a case where the reference density value is not less than the target density value corresponding to the input image signal 10%. In this case, the detected density value corresponding to the input image signal 10% in the test pattern T is invalidated and the tone characteristic is formed by selecting the other detected density values. The post-correction density value is found by linearly interpolating the range between the smallest detected density value (the detected density value corresponding to the input image signal 20%) among the selected values and the point (0, 0) of the density value 0. Then, the tone characteristic of the printer engine is formed by connecting the detected density values corresponding to the input image signals more than 20%.

Moreover, FIG. 11B shows a case where the reference density value is not less than the target density values corresponding to the input image signals 10% and 20%. In this case, the detected density values corresponding to the input image signals 10% and 20% in the test pattern T are invalidated and the tone characteristic is formed by selecting the other detected density values. The post-correction density value is found by linearly interpolating the range between the smallest detected density value (the detected density value corresponding to the input image signal 30%) among the selected values and the point (0, 0) of the density value 0. Then, the tone characteristic of the printer engine is formed by connecting the detected density values corresponding to the input image signals more than 30%.

In this way, when the reference density value is not less than a part of the target density values, the output correction process is applied to a detected density value corresponding to the input image signal of which the reference density value concerned is not less than the target density value. And the tone characteristic is formed using the post-correction density value.

Referring back to FIG. 3, after executing the output correction process (step S104), the CPU 322 generates the density correction table (step S105). That is, the CPU 322 generates the density correction table (LUT) with using the tone characteristic after the output correction process and the target density (a generation unit).

Figure 12:
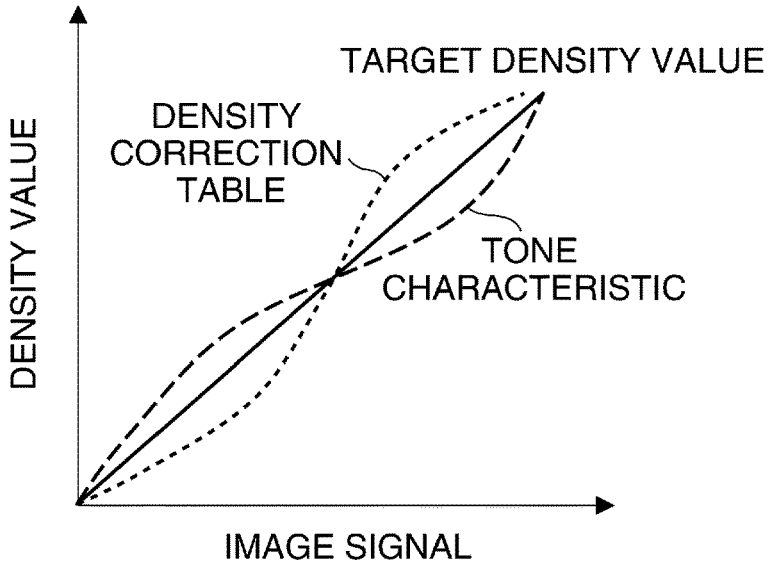
FIG. 12 is a graph for describing a method for generating a density correction table.

FIG. 12 is a graph for describing a method for generating the density correction table. FIG. 12 shows the target density (a straight line) of the image forming apparatus and the tone characteristic (output characteristic, a curve of a coarse broken line) of the printer engine. The density correction table (a curve of a fine broken line) is generated by inversely converting the tone characteristic shown by the curve of the coarse broken line with respect to the linear target density value in FIG. 12. As a result of this, the realistic density correction table is generated on the basis of actual measured values.

Referring back to FIG. 3, after generating the density correction table (step S105), the CPU 322 controls the image processor 310 to store the generated density correction table (step S106), and then, finishes the density correction table generation process.

Execution of the density correction table generation process including the above-mentioned output correction process generates the conversion condition for converting image data so as to obtain ideal image density according to the tone characteristic after the output correction process and the density correction table. The image processor 310 stores this conversion condition. Then, the image processor 310 converts image data on the basis of the conversion condition stored when a print process is executed, and the CPU 322 controls the printer engine 110 to form an image according to the converted image data.

According to the process in FIG. 3, when the reference density value is not less than the target density value corresponding to a part of the input image signals, the tone characteristic is selected without using the detected density value corresponding to the part of the input image signals concerned (the output correction process). Then, the density correction table is generated on the basis of the tone characteristic, and the image of which the density value is corrected using the density correction table concerned is formed. This improves the reliability of the density correction table. Therefore, even if the glossiness of the surface of the intermediate transfer belt 31 is lowered, the influence thereof is reduced and the image of the proper density value is formed. Moreover, since the density value after the output correction process is used as a density value in the low-density region in the tone characteristic, image density in the low-density region in which the input image signal is small is properly controlled. That is, the image forming apparatus that reduces the influence of variation of reflectance of the intermediate transfer medium and forms an image of proper density is provided.

Hereinafter, the effect in the first embodiment will be described concretely. The variation of glossiness of the intermediate transfer belt 31 and a chromaticity change of a gray image in the low-density region that was formed by C (cyan), M (magenta), and Y (yellow) toners of the input image signals 10% were investigated while performing the image forming (printing) operation of 100,000 sheets. As a result, the following results were obtained.

Figure 13:
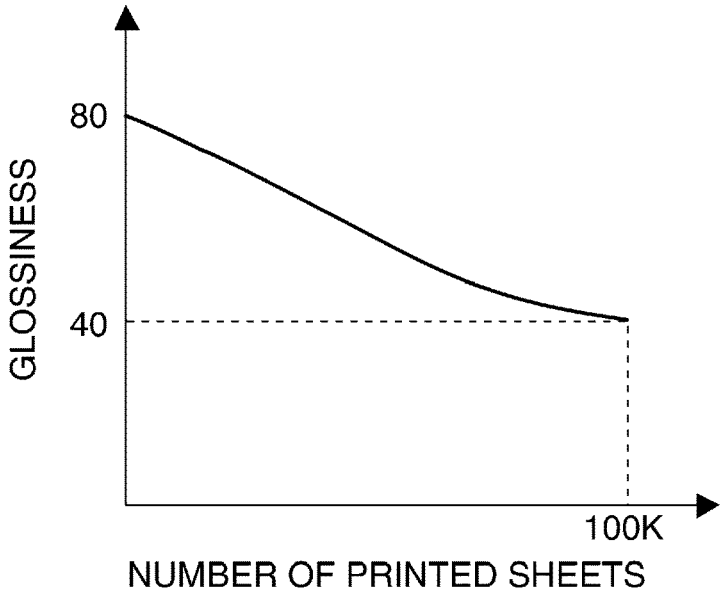
FIG. 13 is a graph showing a relation between a printing sheet number and surface glossiness of an intermediate transfer belt.

That is, as shown in FIG. 13, the glossiness of the surface of the intermediate transfer belt 31 was lowered from 80 to 40 in accordance with the number of printed sheets. FIG. 13 shows that the surface of the intermediate transfer belt 31 becomes coarse gradually with the increase in the number of printed sheets.

Moreover, chromaticity variation of the gray image between a pre-printing state and a post-printing state was found on the basis of perceiving color difference that is a distance between coordinates of the two colors before and after printing. As a result, the color difference ΔE was equal to "5" in a case where the above-mentioned output correction process was not performed, and the color difference ΔE was equal to "3" in a case where the output correction process was performed. This result shows that the influence of the temporal variation of the surface of the intermediate transfer belt 31 is reduced by performing the output correction process in the first embodiment periodically, which enables formation of a satisfactory image.

It should be noted that the above-mentioned glossiness was measured by the method prescribed to JISZ8741. That is, a light flux of the prescribed divergent angle was entered to the surface of the intermediate transfer belt 31 at incident angle 60 degrees, and the light flux of the prescribed divergent angle that was reflected in a direction of specular reflection was measured with an optical receiver. Moreover, the color difference ΔE was calculated by the following methods in the CIE L*a*b* color space.

$$\Delta E=\sqrt{\{(\Delta L^*)^2+(\Delta a^*)^2+(\Delta b^*)^2\}}$$

As mentioned above, the first embodiment is capable of forming an image of satisfactory density while performing the density control, even when the glossiness of the intermediate transfer belt 31 varies temporally and the diffuse-reflection light amount from the intermediate transfer belt 31 varies.

Next, a second embodiment of the present invention will be described. A hardware constitution of the image forming apparatus according to the second embodiment is the same as the hardware constitution of the image forming apparatus according to the first embodiment. In the first embodiment, the influence of the temporal variation of the surface of the intermediate transfer belt 31 in the output correction process is determined by comparing the reference density value and the target density value of the density sensor 60. In the second embodiment, the influence of the temporal variation of the surface of the intermediate transfer belt 31 in the output correction process is determined by comparing the reference density value and the detected density values corresponding to the tones of the test pattern. Hereinafter, the second embodiment will be described by focusing on different points from the first embodiment.

In the first embodiment mentioned above, since the reference density value and the target density are compared, the influence of the temporal variation of the image bearing member may not be corrected properly when the detected density value corresponding to each tone of the test pattern T is largely shifted from the target density value. Accordingly, the influence of the temporal variation of the intermediate transfer belt 31 is determined using the actual detected density value corresponding to each tone of the test pattern T under a certain condition in the second embodiment.

That is, even if the target density value is not more than the reference density value, the corresponding detected density value that is not less than a predetermined multiple of the reference density value is used as a valid value in the second embodiment. The tone characteristic is generated using the validated detected density value concerned and the detected density values corresponding to the target density values that exceed the reference density value. The predetermined multiple is 1.2 (120%), for example.

Figure 14A:
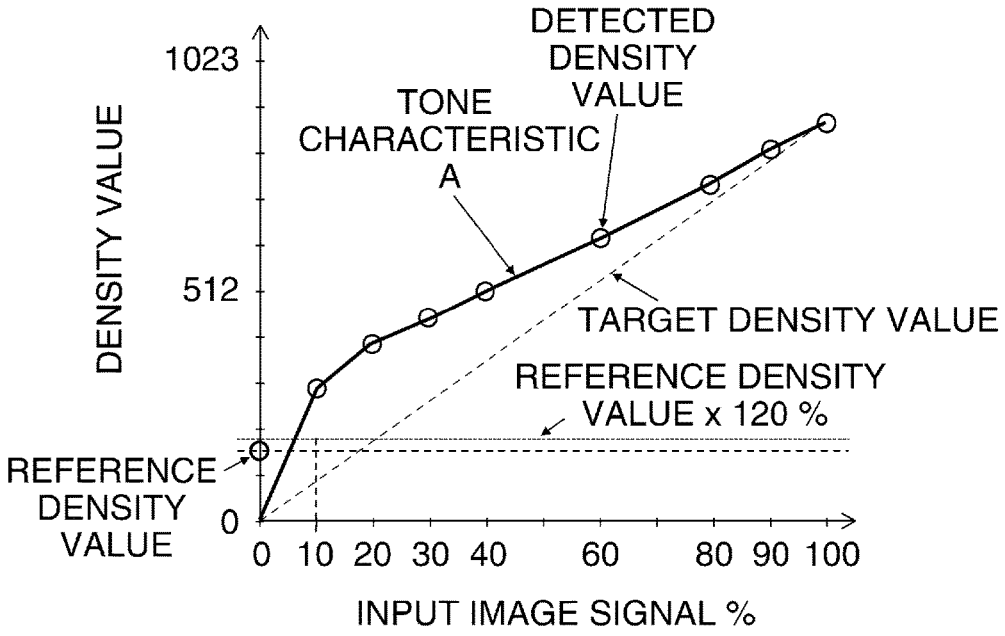
FIG. 14A and FIG. 14B are graphs for describing an output correction process in a second embodiment.
Figure 14B:
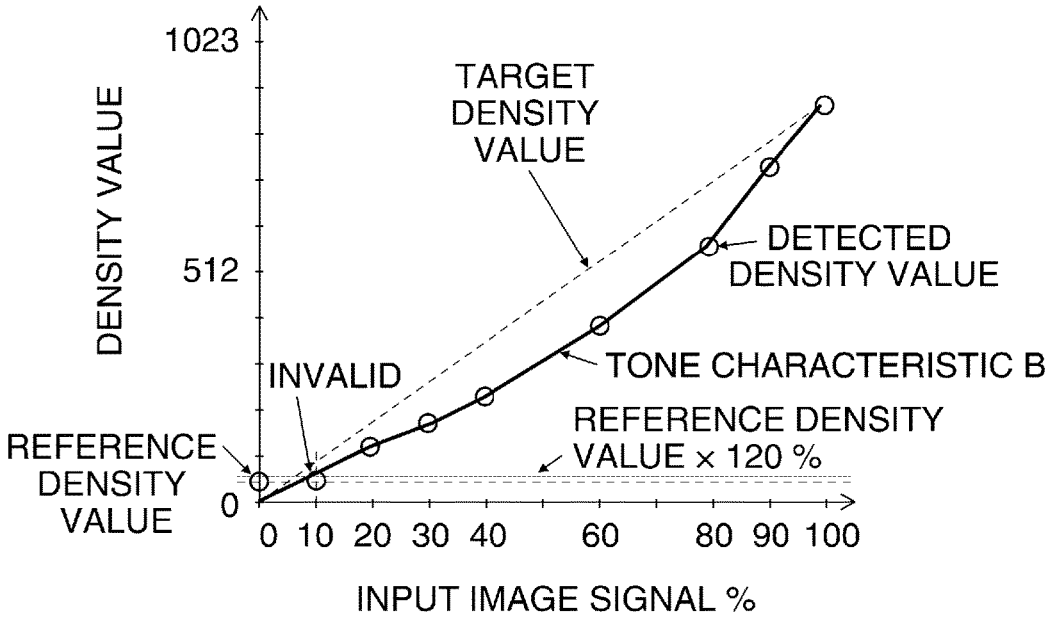

FIG. 14A and FIG. 14B are views for describing an output correction process in the second embodiment.

FIG. 14A is an example where the image density value rises significantly. In this case, although the reference density value is not less than the target density of the measurement image of 10%, the detected density value of the measurement image of 10% is not invalidated and is employed because the detected density value exceeds 120% of the reference density value. That is, the tone characteristic A is found with using the detected density values corresponding to the measurement images of the tones of the input image signals 10% through 100% and the point (0, 0) of the density value 0 corresponding to the measurement image of the input image signal 0%. In this case, since the toner amount corresponding to the measurement image of the input image signal 10% is large, the no-toner area ratio is lowered, which reduces the influence of the temporal variation of the image bearing member. Accordingly, the detected density value corresponding to the measurement image of 10% is determined to satisfy sufficient detection accuracy.

The density correction table is generated using the target density and the tone characteristic A that is obtained with such an output correction process. And the image forming operation is performed while correcting density by applying the generated output correction table.

In the meantime, FIG. 14B is an example where the image density value falls significantly. In this case, although the reference density value is less than the target density of the measurement image of 10%, the detected density value of the measurement image of 10% is invalidated and is not employed because the detected density value falls below 120% of the reference density value. That is, the tone characteristic B is found with using the detected density values corresponding to the measurement images of the tones of the input image signals 20% through 100% and the point (0, 0) of the density value 0 corresponding to the measurement image of the input image signal 0%. The density value between the point (0, 0) of the density value 0 and the detected density value corresponding to the measurement image of the input image signal 20% is found by the linear interpolation.

The density correction table is generated using the target density and the tone characteristic B obtained. And the image forming operation is performed while correcting density by applying the generated output correction table. In this case, since the toner amount corresponding to the measurement image of the input image signal 10% is small, the no-toner area ratio increases, which enlarges the influence of the temporal variation of the image bearing member. Accordingly, the detected density value corresponding to the measurement image of 10% does not satisfy the sufficient detection accuracy.

According to the second embodiment, even if the target density value is not more than the reference density value, the detected density value corresponding to the input image signal of the portion concerned that exceeds 120% of the reference density value is determined to be valid and is used to generate the tone characteristic. This provides a realistic tone characteristic and density correction table even when density variation of a print image in the image forming apparatus is large. Accordingly, it is effective in a case where the image forming operation is performed while setting the frequency of the image density control low, particularly.

It should be noted that the predetermined multiple of the reference density value in comparison with the detected density value is not limited to 120% (1.2 times) and can be changed suitably corresponding to the characteristics of the image forming apparatus.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-065075, filed Mar. 29, 2017, which is hereby incorporated by reference herein in its entirety.

What is claimed is:

1. An image forming apparatus that forms an image on a sheet, the image forming apparatus comprising:

a conversion unit configured to convert image data based on a conversion condition;

an image forming unit configured to form an image based on the converted image data;

an image bearing member;

a measurement unit configured to measure irregular reflection light from a measurement image on the image bearing member; and a controller configured to control the image forming unit to form a plurality of measurement images including a predetermined measurement image based on measurement image data, to control the measurement unit to measure irregular reflection light from an area on the image bearing member where the plurality of measurement images are not formed, to control the measurement unit to measure the irregular reflection light from the plurality of measurement images, to determine whether a measurement result of the predetermined measurement image is selected as a measurement result used for generating the conversion condition based on the measurement result of the area, and to generate the conversion condition based on the selected measurement result, wherein the controller generates the conversion condition based on the measurement result of the predetermined measurement image and measurement results of the other measurement images among the plurality of measurement images in a case where the measurement result of the predetermined measurement image is selected, wherein the controller generates the conversion condition based on the measurement results of the other measurement images without using the measurement result of the predetermined measurement image in a case where the measurement result of the predetermined measurement image is not selected, wherein a density level of the predetermined measurement image is lower than density levels of the other measurement image, wherein the controller determines a reference value based on the measurement result of the area, wherein the controller selects the predetermined measurement image in a case where the reference value is less than a threshold, and wherein the controller does not select the predetermined measurement image in a case where the reference value is more than the threshold.

2. The image forming apparatus according to claim 1, wherein the conversion condition is a density correction table for correcting a tone characteristic of an image is to be formed by the image forming unit.

3. An image forming apparatus that forms an image on a sheet, the image forming apparatus comprising:

a conversion unit configured to convert image data based on a conversion condition;

an image forming unit configured to form an image based on the converted image data;

an image bearing member;

a measurement unit configured to measure irregular reflection light from a measurement image on the image bearing member; and a controller configured to control the image forming unit to form a plurality of measurement images based on measurement image data, to control the measurement unit to measure irregular reflection light from an area on the image bearing member where the plurality of measurement images are not formed, to control the measurement unit to measure the irregular reflection light from the plurality of measurement images, to select a measurement result used for generating the conversion condition from among measurement results of the plurality of measurement images based on the measurement result of the area, and to generate the conversion condition based on the selected measurement result, wherein the predetermined measurement image includes a first measurement image, a second measurement image, and a third measurement image, wherein a density level of the first measurement image is lower than a density level of the second measurement image, wherein the density level of the second measurement image is lower than a density level of the third measurement image, wherein the controller determines a reference value based on the measurement result of the area, wherein the controller selects the measurement results of the first, second, and third measurement images in a case where the reference value is less than a first threshold, and wherein the controller selects the measurement results of the second and third measurement images without selecting the measurement result of the first measurement image in a case where the reference value is more than the first threshold and is less than a second threshold that is more than the first threshold.

4. The image forming apparatus according to claim 3, wherein the first threshold corresponds to a target measurement result of the first measurement image and the second threshold corresponds to a target measurement result of the second measurement image.

5. The image forming apparatus according to claim 3, wherein the first threshold corresponds to the measurement result of the first measurement image and the second threshold corresponds to the measurement result of the second measurement image.

6. The image forming apparatus according to claim 3, wherein the conversion condition is a density correction table for correcting a tone characteristic of an image is to be formed by the image forming unit.

* * * * *